US007608794B2

(12) United States Patent
Pierce

(10) Patent No.: US 7,608,794 B2
(45) Date of Patent: Oct. 27, 2009

(54) PROCESS AND SYSTEM FOR SORTING AND PITTING FRUIT

(75) Inventor: Brian N. Pierce, Chico, CA (US)

(73) Assignee: Sunsweet Growers, Inc., Yuba City, CA (US)

( * ) Notice: Subject to any disclaimer, the term of this patent is extended or adjusted under 35 U.S.C. 154(b) by 271 days.

(21) Appl. No.: 11/409,329

(22) Filed: Apr. 20, 2006

(65) Prior Publication Data

US 2007/0246404 A1 Oct. 25, 2007

(51) Int. Cl.
*B07C 5/00* (2006.01)
*B07C 5/342* (2006.01)

(52) U.S. Cl. ..... 209/579; 209/552; 209/555; 209/580; 209/581

(58) Field of Classification Search ..... 209/552, 209/555, 579, 580, 581
See application file for complete search history.

(56) References Cited

U.S. PATENT DOCUMENTS 3,628,657 A * 12/1971 Billett ..... 209/579
3,930,994 A * 1/1976 Conway et al. ..... 209/579
4,120,402 A 10/1978 Swanson
4,369,886 A * 1/1983 Lane et al. ..... 209/564
4,485,732 A 12/1984 Goudard
4,511,046 A 4/1985 Walsh et al.
4,558,786 A 12/1985 Lane
4,666,045 A * 5/1987 Gillespie et al. ..... 209/585
RE33,357 E 9/1990 Randall
5,000,569 A * 3/1991 Nylund ..... 356/237.1
5,024,147 A 6/1991 Petit et al.
5,335,293 A 8/1994 Vannelli et al.
5,526,437 A 6/1996 West
5,577,439 A 11/1996 Cimperman
5,945,206 A * 8/1999 Jogan et al. ..... 428/215
5,954,206 A * 9/1999 Mallon et al. ..... 209/580
5,986,230 A * 11/1999 Novak et al. ..... 209/579
6,080,950 A 6/2000 Jalink
6,201,602 B1 3/2001 Bouvyn
6,225,620 B1 5/2001 Campbell et al.
6,303,925 B1 * 10/2001 Edmonds ..... 250/223 R (Continued)

FOREIGN PATENT DOCUMENTS

GB 2292455 A 2/1996

(Continued)

*Primary Examiner*—Patrick H Mackey
*Assistant Examiner*—Terrell H Matthews
(74) *Attorney, Agent, or Firm*—Townsend and Townsend and Crew LLP.; M. Henry Heines

(57) ABSTRACT

Drupaceous fruit pieces, including fruit flesh with and without pit matter adhering to the flesh as well as loose pits and pit pieces themselves, are passed through an integrated system of multiple sorting units utilizing different sorting methodologies. The sorting units include a laser-based sorting unit that sorts according to differences in light scattering, a diode-based sorting unit that sorts according to differences in light reflectance, and in certain embodiments a camera-based sorting unit that sorts according to differences in color. The system also includes an impact separator that dislodges pit material from fruit flesh from which the pit material has not been dislodged by any preceding units, most notably by pitting machinery through which the fruit has passed prior to entering the system of the invention.

13 Claims, 1 Drawing Sheet

U.S. PATENT DOCUMENTS 6,305,551 B1 * 10/2001 Ruymen ..... 209/644
6,646,218 B1 11/2003 Campbell et al.
6,734,383 B1 * 5/2004 Calcoen et al. ..... 209/577
6,748,837 B2 6/2004 Benjamin et al.

FOREIGN PATENT DOCUMENTS

WO WO 96/00621 A1 1/1996

* cited by examiner

PROCESS AND SYSTEM FOR SORTING AND PITTING FRUIT

BACKGROUND OF THE INVENTION

1. Field of the Invention

This invention arises in the field of processing fruits, particularly dried drupaceous fruits, to remove pits.

2. Description of the Prior Art

Drupaceous fruits, and particularly such fruits in dried, including partially dried, form, are part of a large agribusiness whose products are distributed worldwide. The appeal of these fruits arises from their high nutritional value, their appealing texture and taste, the ease with which they can be stored and carried by consumers for snacks and quick meals, and their ability to retain their nutritional value, texture and taste over extended periods of time without spoilage. The pitting of these fruits is a critical part of their processing, and reliable pitting is needed both to ensure the appeal of the fruits and to avoid injury to the consumer. For many of these fruits, industrial scale pitting is achieved by mechanical equipment in complex production lines that include a succession of stages that raise and lower both the temperature and moisture levels of the fruit to loosen the bonds between the pits and the fruit flesh, in addition to stages for cutting the fruit and extracting the pits. Variability within each of these functions, together with variations in the fruits themselves and the mechanical nature of the equipment, are potential sources of error.

The presence of pits and foreign objects in general is a concern not only in foods but also in bulk goods such as tobacco and textiles. To remove such objects and maintain acceptable quality levels of these goods, sorting systems have been developed by industrial equipment manufacturers such as Key Technology of Walla Walla, Wash., USA; BEST USA Inc., Centennial, Colo., USA; Odenburg Engineering, Inc., West Sacramento, Calif., USA; and Barco N.V., Kortrijk, Belgium. These sorters differentiate materials according to differences in the optical characteristics of the materials, such as color, light scattering, light reflection, and fluorescence emissions. Each sorting methodology has its limitations, however, and as a result these sorters tend to generate both false positives and false negatives, leading to the passage of defective product and the rejection of usable product. The use of any of these sorters, regardless of their methodology, presents a particular problem in the processing of drupes due to the tendency of pits to adhere to the flesh of the drupe.

SUMMARY OF THE INVENTION

The present invention resides in an integrated system for sorting and refining drupaceous fruit matter, and in the process of using such a system. The invention is of particular interest for drupaceous fruits or fruit pieces that have already passed through conventional pitting machines. The system integrates two or more discrete sorting units, including a laser-based sorting unit that utilizes light scattering properties in differentiating fruit flesh from pits, and a diode-based sorting unit that utilizes light reflectance in differentiating fruit flesh from pits, plus a fluid jet of sufficient force to physically dislodge pits that are still adhering to fruit flesh despite the fruit having passed through a pitting stage that is upstream of the sorting and refining system. The term "fluid jet" is used generically herein to denote a jet of either gas or liquid. The sorting units are arranged in series and the fluid jet is positioned between the different sorting units so that a stream of fruit matter passes through a sorting unit utilizing one of the two methodologies (i.e., laser or diode), is then subjected to the impact of the fluid jet, and then passes through a sorting unit utilizing the other of the two methodologies. The combination of different sorting methodologies and the impact of the fluid jet results in a significantly improved product output relative to the use of either methodology on its own, even with recycling through a single methodology.

In addition to the basic components described in the preceding paragraph, certain embodiments of the invention contain one or more sorting units employing further sorting methodologies, one example of which is a camera-based sorting unit that differentiates by pixel count, color, or both. Certain embodiments of the invention also include one or more recycle streams that direct product having passed through sorters employing two or more methodologies back through one or both before being recovered or advanced further along the process line.

Further features, advantages, and embodiments of the invention will be apparent from the description that follows.

DETAILED DESCRIPTION OF THE INVENTION AND PREFERRED EMBODIMENTS

Figure 1:
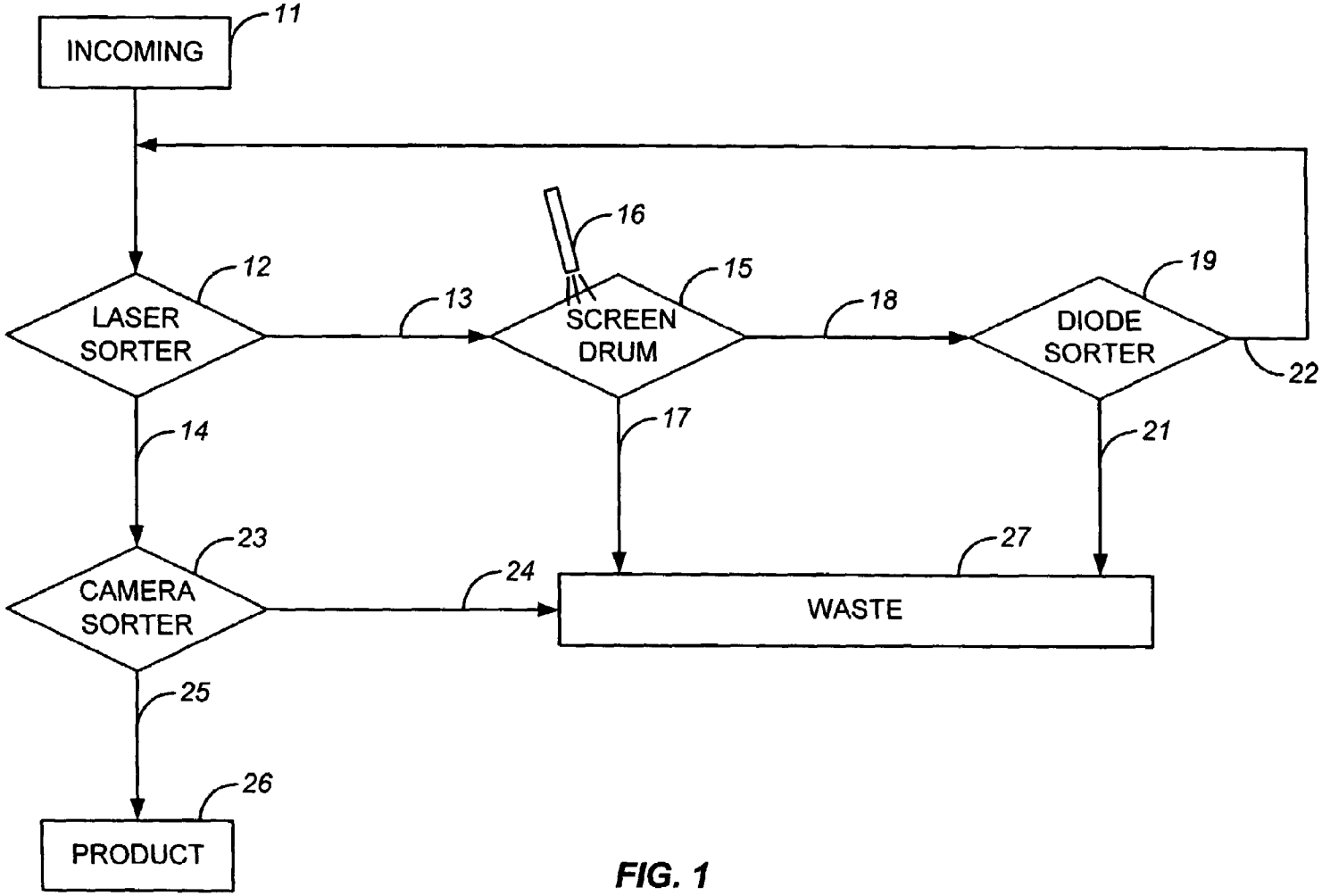
FIG. 1 is a process flow diagram of a portion of a drupe processing plant in accordance with the present invention.

The term "fruit matter" is used herein to denote both whole fruit and fruit pieces, including fruit flesh with pits intact, fruit flesh that is free of pits, fruit flesh from which pits have been partially loosened but with pits or pit pieces still adhering to the flesh, and the pits themselves. The term "fruit flesh" is used herein to denote the portion of the fruit other than the pits, and may include the entire flesh from a single fruit, or a section of the flesh that has been severed or otherwise disconnected from the remainder of the flesh. The term "pits" is used herein to denote both whole pits and pit pieces. The term "substantially free of pits" is used herein to denote a stream of fruit matter that contains either no pits or pits constituting less than 250 defects in 1,000,000 pieces. The industry standard as of the filing date of this patent application is a maximum of 5,000 defects in 1,000,000 pieces, while the actual industry practice is a maximum of 3,000 defects in 1,000,000 pieces. The term "pit-free fruit flesh" is used herein to denote fruit flesh that is entirely free of pits. The term "fruit-flesh-rich" is used herein to refer to fruit matter that has a higher proportion of pit-free fruit flesh than fruit mater at a point upstream in the process, by reason of having passed through one more of the sorting units.

A laser sorting unit that can be used in the practice of this invention is one that directs a laser-generated light beam at the stream of fruit matter and detects scattered light returned from the fruit matter as the result of Raman scattering or as the result of direct reflected light. The difference in intensity between the scattered light from fruit flesh and the scattered light from pits allows the sorter to identify the presence and location of pits in the moving stream, and to then eject them from the stream by a highly localized force such as the impact of a narrow jet of pressurized fluid. The coherent light of the laser beam allows the scattered light to be readily differentiated by electronic means. The stream of fruit matter passing through the laser sorter is arranged such that each of the individual particles is directly contacted by the laser beam. This is conveniently achieved by spreading the particles into a falling sheet or curtain, and scanning the width of the sheet with a laser beam in a reciprocating manner. The reciprocating motion of the laser beam can be achieved by reflecting the beam from a rotating polygon with mirror surfaces at each of the peripheral faces of the polygon. The rotating polygon and other features of the sorter are shown and described in Calcoen, J., et al., U.S. Pat. No. 6,734,383 B1, issued on May 11, 2004, and references cited therein, notably DeBeers United Kingdom published patent application no. GB 2 292 455 A, publication date Feb. 21, 1996, and Institute für Chemo-und Biosensorik Münster E. V., International (PCT) Patent Publication WO 96/00621, published Jan. 11, 1996. The contents of each of these documents are incorporated herein by reference. Parameters other than light scattering can also be detected within the same unit and used for differentiation in addition to the scattering features. Examples of these additional parameters are color and fluorescence emission. The sensitivity of the sorter can be controlled by adjustment of various instrument parameters such as the threshold intensity that will activate ejection, the duration of an intensity peak that will activate ejection, and the wavelength of the laser beam.

A diode-based sorting unit that can be used in the practice of this invention is one that utilizes an array of light-emitting diodes as light sources to illuminate the pieces in the stream with rapid pulses of light. The diodes in the array may be of different frequencies or arranged to illuminate different segments of the moving stream of fruit matter, and the light pulses will typically occur in cycles that will include each diode in succession, with one hundred of more such cycles per second. Light reflected from the pieces is focused by appropriate lenses onto detectors such as photodiodes, CCDs (charge-coupled diodes), CMOS (complementary metal-oxide semiconductor), and cells such as silicon detector cells and lead sulfide detector cells. The lenses individually receive reflected light from localized segments of the moving stream, and the detectors identify the presence of pits in the localized segments corresponding to individual lenses by the lack of light reflected from the pits or by a difference in the degree or quality of reflection. The pits are then selectively diverted from the stream by a localized force such as the impact of a narrow jet of pressurized fluid or a mechanical diverter such as a pushrod. Disclosures of these types of systems are found in Lane, M.M., U.S. Pat. No. 4,558,786, issued Dec. 17, 1985; Nylund, S. L. U.S. Pat. No. 5,000,569, issued Mar. 19, 1991, and Bouvyn, P., U.S. Pat. No. 6,201,602 B1, issued Mar. 13, 2001. The contents of these patents are incorporated herein by reference.

In the practice of the invention, the fruit matter can pass through the laser-based sorting unit prior to the diode-based sorting unit, or vice versa, in either case with the pit dislodgment stage in between. In preferred systems, the laser-based sorting unit is the first of the sorting units that incoming fruit matter passes through. Regardless of the order in which they are used, the sorting units each produce an accepted product stream and a reject stream. The stream from one sorting unit that is directed to the succeeding sorting unit can be either the accepted product stream or the reject stream. When the laser-based sorting unit precedes the diode-based sorting unit, the stream from the laser-based unit that is directed to the diode-based unit is preferably the reject stream from the laser-based unit. This reject stream, however, prior to entering the diode-based sorting unit, will first be subjected to impingement by the fluid jet for dislodgment of adhering pits, and preferably any pits that are dislodged in this fluid-jet stage will be removed before the stream enters the diode-based sorting unit. As noted above, one of the streams emerging from the second sorting unit in certain embodiments of this invention is recycled to the first sorting unit. This recycled stream can either be the accepted product stream or the reject stream.

Certain sorting units that are currently available from commercial suppliers already incorporate jets for removing rejected material. When used in the practice of this invention, however, the jets in these sorting units are preferably modified to produce an increased jet pressure to further dislodge any adhering pit matter. Alternatively, independent jets can be incorporated into the system to either replace or supplement the jets that are included in the sorting units. The units can also be configured to cause their jets to fire at accepted material rather than reject material. In some flow schemes, particularly those involving a recycle stream, this will provide further assurance that undesirable product is not re-introduced back into the accepted product stream.

The fluid jet that serves as a pit dislodgment stage between the laser-based and diode-based sorting units utilizes any inert fluid that will exert sufficient force to dislodge loosely or weakly adhering pits from the fruit flesh. An air (or any gas) jet is preferred. The water pressure and speed of the jet are not critical and can vary widely according to the needs of the fruit. A useful range of water pressure for pitted prunes, for example, is from about 60 psi to about 200 psi. Any modifications of this range for other fruits will be apparent to those skilled in the food processing industry. The pits dislodged by the jet can be removed from the stream by mechanical screening, such as by a vibrating or rotating screen or a screening drum that will separate the pits by gravity and/or allow the pits to drop through the small apertures of the screen. Screening or tumbling drums useful for this purpose are manufactured by Machine and Process Design, Inc., of Anoka, Minn., USA, and other manufacturers of food processing equipment. Alternatively, separation of the pits can be omitted and the moving stream with dislodged pits simply advanced to the next sorting unit for separation.

As noted above, certain embodiments of the invention include a camera-based sorting unit in addition to the laser-based and diode-based sorting units described above. Camera-based sorting units typically utilize either a monochrome or a color video system to form a video image of the moving stream, the image electronically divided into discrete mixture elements or "pixels," each with an associated value that represents the intensity of the portion of the image corresponding to the pixel. For color images, the color value will be expressed in multiple variables corresponding to different colors, such as for example red, green, and blue. The pixel is then classified by its color value relative to a threshold selected to represent the distinction between fruit flesh and pits. Once a pixel is identified that indicates the presence of a pit, the pit is selectively diverted from the stream by a localized fluid jet or mechanical ejector. Actuation of the jet or ejector can be performed in an automated manner by localized mechanisms of the types described above in connection with diode-based sorting units. Computerized ejection systems are useful in estimating the location of a free-falling object for ejection, and certain computerized systems offer the user the capability of selecting the type of defect to be used as the basis for ejection. Further descriptions of camera-based systems are found in Swanson, R. E., U.S. Pat. No. 4,120,402, issued Oct. 17, 1978; Vanelli, A., et al., U.S. Pat. No. 5,335,293, issued Aug. 2, 1994; and West, J. K., U.S. Pat. No. 5,526,437, issued Jun. 11, 1996. The contents of these patents are incorporated herein by reference. In embodiments that contain camera-based sorting systems, the camera-based system is preferably used as the final stage of the operation.

The conveyance of the fruit matter between the various stages of the systems of this invention, i.e., the various sorting units and the pit dislodgment stage, can be achieved by any conventional means for a continuous process. At locations where each of the individual pieces of fruit matter must receive full exposure to a light beam, the pieces can be separated into either a single-file stream or a moving sheet that is no more than one piece in thickness. Also as noted above, the removal from the stream of pits whose presence and location have been identified can be achieved by pneumatic, hydraulic, or mechanical means.

A further feature in preferred embodiments of this invention is a monitoring system generating either feedback signals and or alarms or both. In this system, data from one or more of the sorting units, and preferably each sorting unit, is relayed to a central processor which compares the data to a target range and generates a signal representative of the comparison. The reject count is an example of data that can be transmitted and compared in this manner. When the data is outside the target range, a signal can be generated by the processor, and the signal can be acted upon either by an operator in a manual mode or by automated instrumentation. The action in either case can adjust an appropriate parameter in the particular sorting unit giving rise to the signal. The appropriate parameter can for example be a reject threshold in the form of a peak height or other parameters such as a peak width. As an alternative to adjustment of a sorter parameter, the response of the feedback system can be a simple warning system such as an audible or visual alarm. Data input to the feedback system can include data on the incoming product stream in addition to the reject streams and accepted product streams. The feedback system can also be used for real-time feedback between the two sorting units. Still further, the feedback system can serve as a means for detecting an improperly adjusted or malfunctioning sorting unit.

The features that characterize this invention can be implemented in a wide variety of equipment configurations. The FIGURE hereto is a processing plant flow diagram that embodies one such configuration and is described below.

Fruit matter 11 to be sorted and refined in the process configuration of the FIGURE is preferably fruit that has been pitted by pitting machines such as a Sunsweet pitter (Sunsweet Growers, Inc., Yuba City, Calif., USA) or those described in Goudard, Y., U.S. Pat. No. 4,485,732, issued Dec. 4, 1984; Walsh, R. J., et al., U.S. Pat. No. 4,511,046, issued Apr. 16, 1985; Petit, G., et al., U.S. Pat. No. 5,024,147, issued Jun. 18, 1991; and Cimperman, F. J., et al., U.S. Pat. No. 5,577,439, issued Nov. 26, 1996. The contents of each of these patents are incorporated herein by reference. The pitted fruit matter may contain fruit flesh, loose whole pits, loose pit pieces, and whole pits and pit pieces that still adhere to fruit flesh despite having passed through the pitting machine, or any combination of flesh, pits and pit pieces. The incoming fruit matter is conveyed through the various stages described below by a combination of conveyor belt and free fall. The fruit matter first passes through a laser-based sorting unit 12 which diverts undesired matter, notably whole pits and pit pieces in a reject stream 13, leaving the remainder as an accepted product stream 14. The reject stream 13 from the laser sorting unit 12 passes into a screening drum 15 where the reject stream is impinged by a waterjet 16 that dislodges any remaining pits from fruit flesh. The screening action of the screening drum 15 separates out the dislodged pits in a second reject stream 17, leaving a second accepted product stream 18 which is passed to a diode-based sorting unit 19. The diode-based sorting unit 19 identifies any remaining pits or further undesired matter in the stream and diverts the undesired matter into a third reject stream 21, leaving the remainder as a third accepted product stream 22 which is recycled to the inlet to the laser sorting unit 12. The accepted product stream 14 emerging from the laser sorting unit 12 is passed through a camera sorting unit 23 for a final sort, producing a fourth reject stream 24 that is diverted from the product stream to leave a final accepted product stream 25 that is collected 26 and ready for sale or further processing. The three reject streams 17, 21, 24 that are not passed on to further sorting are combined into a single product waste 27. The streams identified in this paragraph as "accepted product streams" are also referred to herein as "fruit-flesh-rich streams."

The present invention is applicable to the processing of drupes in general, including cherries, peaches, plums, dates, nectarines, and apricots, with particular (although not limiting) interest in dried forms of these drupes. Plums and dates are preferred, and plums, notably prunes, are the most preferred.

The foregoing is presented primarily for purposes of illustration and is not intended to limit the scope of the invention. Further variations in the system components, configurations, arrangements, and operating conditions will be readily apparent to those skilled in the art and are intended to be encompassed within the scope of this invention.

What is claimed is:

1. A process for sorting and pitting fruit matter comprising fruit flesh and pits to dislodge pits from said fruit flesh and to extract fruit flesh from said fruit matter in a form substantially free of pits, said process comprising:

passing said fruit matter through a laser-based sorting unit and a diode-based sorting unit, in succession and in any order, said laser-based sorting unit differentiating said fruit flesh from said pits by differences in light scattering, and said diode-based sorting unit differentiating said fruit flesh from said pits by differences in light reflectance, each said sorting unit forming a unit input stream and two unit output streams whereby one of said unit output streams, defined as a fruit-flesh-rich output stream, has a higher proportion of pit-free fruit flesh than said unit input stream;

at a location between said laser-based sorting unit and said diode-based sorting unit, contacting said fruit matter with a fluid jet of sufficient force to dislodge pits adhering to fruit flesh; and recovering as product fruit flesh that has passed through both said laser-based sorting unit and said diode-based sorting unit and that is substantially free of pits.

2. The process of claim 1 wherein said fruit matter is passed through said laser-based sorting unit prior to said diode-based sorting unit.

3. The process of claim 1 further comprising extracting from said fruit matter pits that have been dislodged from fruit flesh by said fluid jet, prior to passing said fruit matter through any of said sorting units that are downstream of said fluid jet.

4. The process of claim 1 further comprising recycling said fruit-flesh-rich output stream leaving the furthest downstream of said sorting units back to the furthest upstream of said sorting units, and wherein said product is recovered from said fruit-flesh-rich output stream leaving the furthest upstream of said sorting units.

5. The process of claim 1 wherein said fruit matter is passed through said laser-based sorting unit prior to said diode-based sorting unit, and said fruit-flesh-rich output stream leaving said diode-based sorting unit is recycled to said laser-based sorting unit.

6. The process of claim 1 further comprising refining said product fruit flesh by passing said product through a camera-based sorting unit differentiating said fruit flesh from said pits by differences in pixel count, color, or both.

7. Apparatus for sorting and pitting fruit matter comprising fruit flesh and pits to dislodge pits from said fruit flesh and to extract fruit flesh from said fruit matter in a form substantially free of pits, said apparatus comprising:

a laser-based sorting unit that differentiates fruit flesh from pits by differences in light scattering;

a diode-based sorting unit that differentiates fruit flesh from pits by differences in light reflectance;

fluid jet means for producing a fluid jet of sufficient force to dislodge pits adhering to fruit flesh; and conveying means for conveying fruit matter first through one of said sorting units, then through said fluid jet means, and then through said diode-based sorting means.

8. The apparatus of claim 7 wherein said conveying means conveys said fruit matter through said diode-based sorting unit after said laser-based sorting unit.

9. The apparatus of claim 7 further comprising recycling means for recycling fruit matter leaving one of said sorting units to the other of said sorting units.

10. The apparatus of claim 8 further comprising recycling means for recycling fruit matter leaving said diode-based sorting unit to said laser-based sorting unit.

11. The apparatus of claim 7 further comprising a camera-based sorting unit that differentiates fruit flesh from pits by differences in pixel count, color, or both.

12. A process for sorting fruit matter comprising fruit flesh and pits to extract fruit flesh from said fruit matter in a form substantially free of pits, said process comprising:

passing a feed stream of said fruit matter through a laser-based sorting unit that differentiates fruit flesh from pits by differences in light scattering and that ejects pits from said feed stream into a first reject stream and thereby converts said feed stream to a first fruit-flesh-rich stream;

contacting said first reject stream with a fluid jet of sufficient force to dislodge pits from fruit flesh to which said pits are adhering and to thereby produce an intermediate stream;

passing said intermediate stream through a diode-based sorting unit that differentiates said fruit flesh from said pits by differences in light reflectance and that ejects fruit flesh from said intermediate stream into a second fruit-flesh-rich stream; and recovering, as product, fruit flesh from said first fruit-flesh-rich stream and fruit flesh from said second fruit-flesh-rich stream.

13. The process of claim 12 further comprising recycling said second fruit-flesh-rich stream to said laser-based sorting unit.

* * * * *